US011447312B2

(12) United States Patent
Chu

(10) Patent No.: US 11,447,312 B2
(45) Date of Patent: Sep. 20, 2022

(54) CONTAINER WITH LENS FOR OBSERVING CONTENTS THEREIN

(71) Applicant: CHU'S CO., LTD., Taipei (TW)

(72) Inventor: Han-Hsuan Chu, Taipei (TW)

(73) Assignee: CHU'S CO., LTD., Taipei (TW)

( * ) Notice: Subject to any disclaimer, the term of this patent is extended or adjusted under 35 U.S.C. 154(b) by 0 days.

(21) Appl. No.: 17/150,058

(22) Filed: Jan. 15, 2021

(65) Prior Publication Data

US 2022/0227550 A1 Jul. 21, 2022

(51) Int. Cl.

| | |
|---|---|
| ***B65D 51/24*** | (2006.01) |
| ***B65D 53/02*** | (2006.01) |
| ***B65D 51/16*** | (2006.01) |
| ***A47F 7/28*** | (2006.01) |
| ***B65D 25/10*** | (2006.01) |
| ***B65D 25/54*** | (2006.01) |
| ***B65D 85/00*** | (2006.01) |
| *A45D 34/02* | (2006.01) |
| *B65D 85/50* | (2006.01) |

(52) U.S. Cl.

CPC ..... *B65D 51/24* (2013.01); *A47F 7/286* (2013.01); *B65D 25/10* (2013.01); *B65D 25/54* (2013.01); *B65D 51/1683* (2013.01); *B65D 53/02* (2013.01); *B65D 85/70* (2013.01); *A45D 34/02* (2013.01); *B65D 85/50* (2013.01); *B65D 2201/00* (2013.01)

(58) Field of Classification Search

CPC .... B65D 25/45; B65D 51/24; B65D 51/1683; B65D 58/70; B65D 58/50; B65D 25/10; B65D 2201/00; B65D 2203/12; B65D 11/02; A45D 34/02; A47F 7/286

USPC ..... 359/804

See application file for complete search history.

(56) References Cited

U.S. PATENT DOCUMENTS

| | | | | |
|---|---|---|---|---|
| 4,579,245 | A * | 4/1986 | Narushko | B65D 47/265 220/253 |
| 4,979,332 | A * | 12/1990 | Nagaya | A01G 9/02 47/69 |
| D706,995 | S * | 6/2014 | Modi | D30/129 |
| 9,630,747 | B2 | 4/2017 | Smith et al. | |
| D817,100 | S * | 5/2018 | Xu | D7/532 |
| 10,384,834 | B2 | 8/2019 | Smith et al. | |
| 10,836,537 | B2 * | 11/2020 | Whetsel | B65D 25/54 |
| 2008/0314786 | A1 * | 12/2008 | Wang | A61J 1/03 206/528 |
| 2009/0236258 | A1 * | 9/2009 | Connell | B65D 25/54 206/540 |
| 2013/0212981 | A1 * | 8/2013 | Chait | B65B 23/06 53/443 |
| 2013/0213911 | A1 * | 8/2013 | Theisen | G09F 3/204 211/59.4 |
| 2016/0031605 | A1 * | 2/2016 | Bean | B65D 51/16 206/1.5 |

(Continued)

*Primary Examiner* — James N Smalley
*Assistant Examiner* — Jennifer Castriotta
(74) *Attorney, Agent, or Firm* — Muncy, Geissler, Olds & Lowe, P.C.

(57) ABSTRACT

A container includes a bottom box and a top lid. The bottom box includes a containing space adapted to contain the contents. The bottom box has a tilted shape wherein the bottom box has one side height greater than another side height. The top lid includes an integrally formed lens and formed with a plurality of air holes on a top surface thereof. The top lid is removably assembled with the bottom box.

17 Claims, 6 Drawing Sheets

(56) References Cited

U.S. PATENT DOCUMENTS

| | | | |
|---|---|---|---|
| 2016/0318672 | A1 | 11/2016 | Smith et al. |
| 2017/0190482 | A1 | 7/2017 | Smith et al. |
| 2020/0071029 | A1 | 3/2020 | Smith et al. |

* cited by examiner

CONTAINER WITH LENS FOR OBSERVING CONTENTS THEREIN

BACKGROUND OF THE INVENTION

1. Field of the Invention

The present invention relates to a container and, more particularly, to a container with lens for observing contents therein.

2. Description of Related Art

Shops may store the fragrant materials, such as tea leaf or medicine powder, in a transparent box, so that customers can see the color or the state of the fragrant materials inside the box directly. Customers may further desire to smell the fragrant materials, and they need to open the box for the fragrance to flow out. However, such action may damage or leak the fragrant materials. In some worse cases, high value products of fragrant materials may be exposed at a risk of being stolen.

In the aspect of security, some stored materials are dangerous for children, so the storing box should be designed so as to prevent the children from playing them or even from swallowing them.

Therefore, it is desirable to provide an improved container easy for users to see and smell the fragrant materials inside it without opening the container.

SUMMARY OF THE INVENTION

According to one aspect of the present invention, there is provided a container with lens for observing contents therein. The container includes a bottom box and a top lid. The bottom box includes a containing space adapted to contain the contents. The bottom box has a tilted shape wherein the bottom box has one side height greater than another side height. The top lid includes a lens and formed with a plurality of air holes on a top surface thereof. The top lid is removably assembled with the bottom box.

Optionally, the whole or a part of the top lid and/or the whole or a part of the bottom box is transparent, semi-transparent, or opaque.

Optionally, the lens is integrally formed in the top lid, and the lens and the top lid are made of same material and by same manufacturing process.

Optionally, the top lid further includes a sliding rail below the top surface and a sliding plate sliding along the sliding rail, and the sliding plate is formed with a plurality of air channels corresponding to the air holes on the top surface.

Optionally, the sliding plate includes a protrusion emerging above the top surface of the top lid, and the sliding plate slides forward or backward along the sliding rail when a force is applied to the protrusion.

Optionally, the sliding rail and the sliding plate are adjacent to the lens.

Optionally, the sliding rail and the sliding plate are arc-shaped fitting a part of a circumference of the lens.

Optionally, the bottom box includes an outer shell, the outer shell has an upper section forming the containing space and a lower section forming an external space, and the containing space is isolated from the external space.

Optionally, the outer shell is formed with an anti-theft hole and an anti-theft channel which are adapted for an anti-theft chain to pass through.

Optionally, the bottom box includes a recess serving as a part of the containing space.

Optionally, the recess is located on a symmetric axis of the lens.

Optionally, the recess is located in front of a focal point of the lens.

Optionally, the bottom box further includes one or more sloped walls connected with the recess.

Optionally, a slope of one sloped wall is different to a slope of another sloped wall.

Optionally, the sloped walls are integrated into a continuous wall surrounding the recess.

Optionally, the top lid further includes one or more female couplers, and the bottom box further includes one or more male couplers capable of coupling to the female couplers.

Optionally, each male coupler is shaped so as to be coupled with each female coupler by a rotational force and a subsequent pulling force; or each male coupler is shaped so as to be decoupled from each female coupler by a pushing force and a subsequent rotational force.

Optionally, the top lid and/or the bottom box has a columnar shape.

Optionally, a diameter of the top lid is equally to a diameter of the bottom box.

Optionally, the container further includes an O-ring arranged between the top lid and the bottom box.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
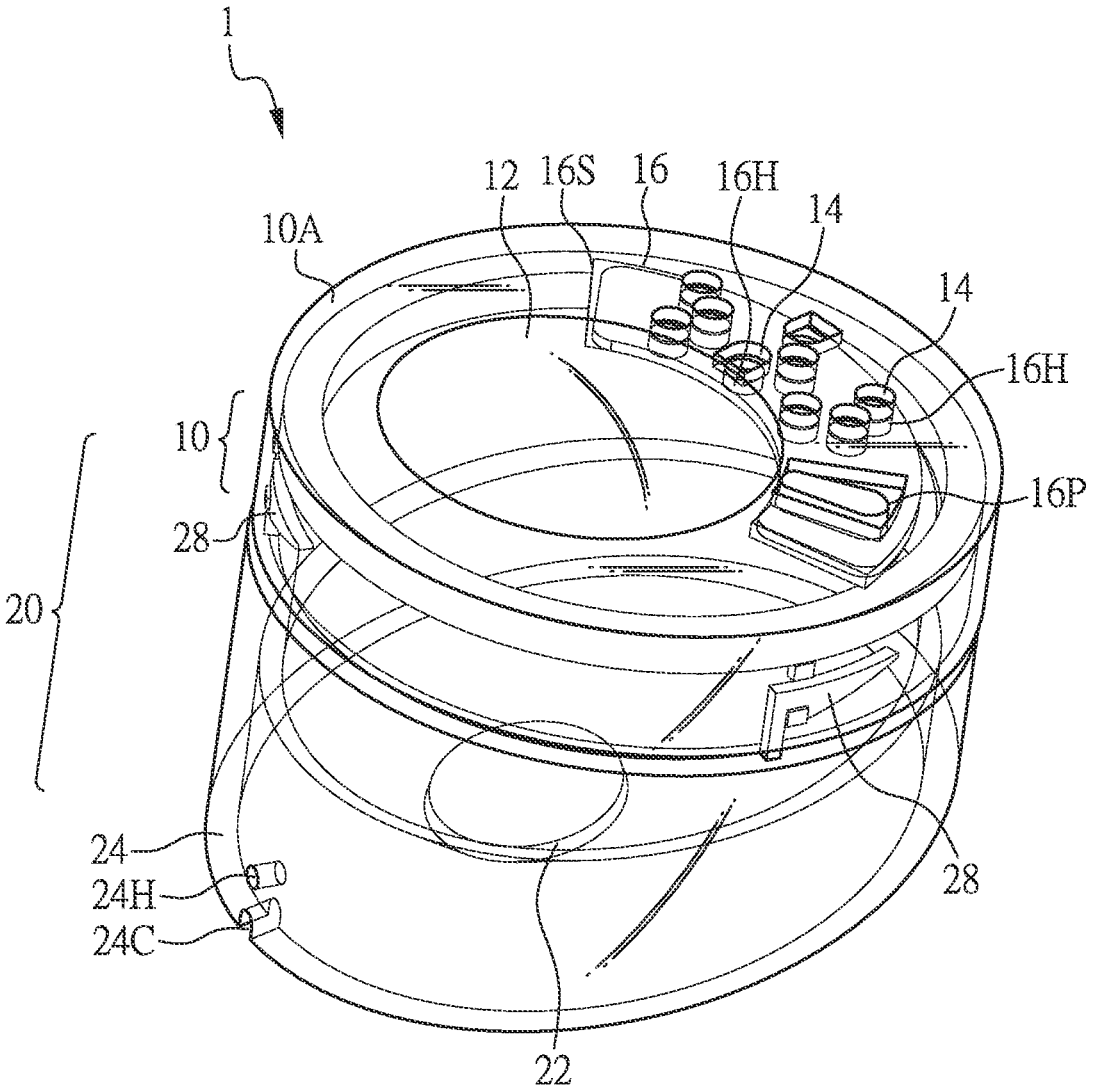
FIG. 1 shows a perspective view of the container according to one embodiment of the present invention.
Figure 2:
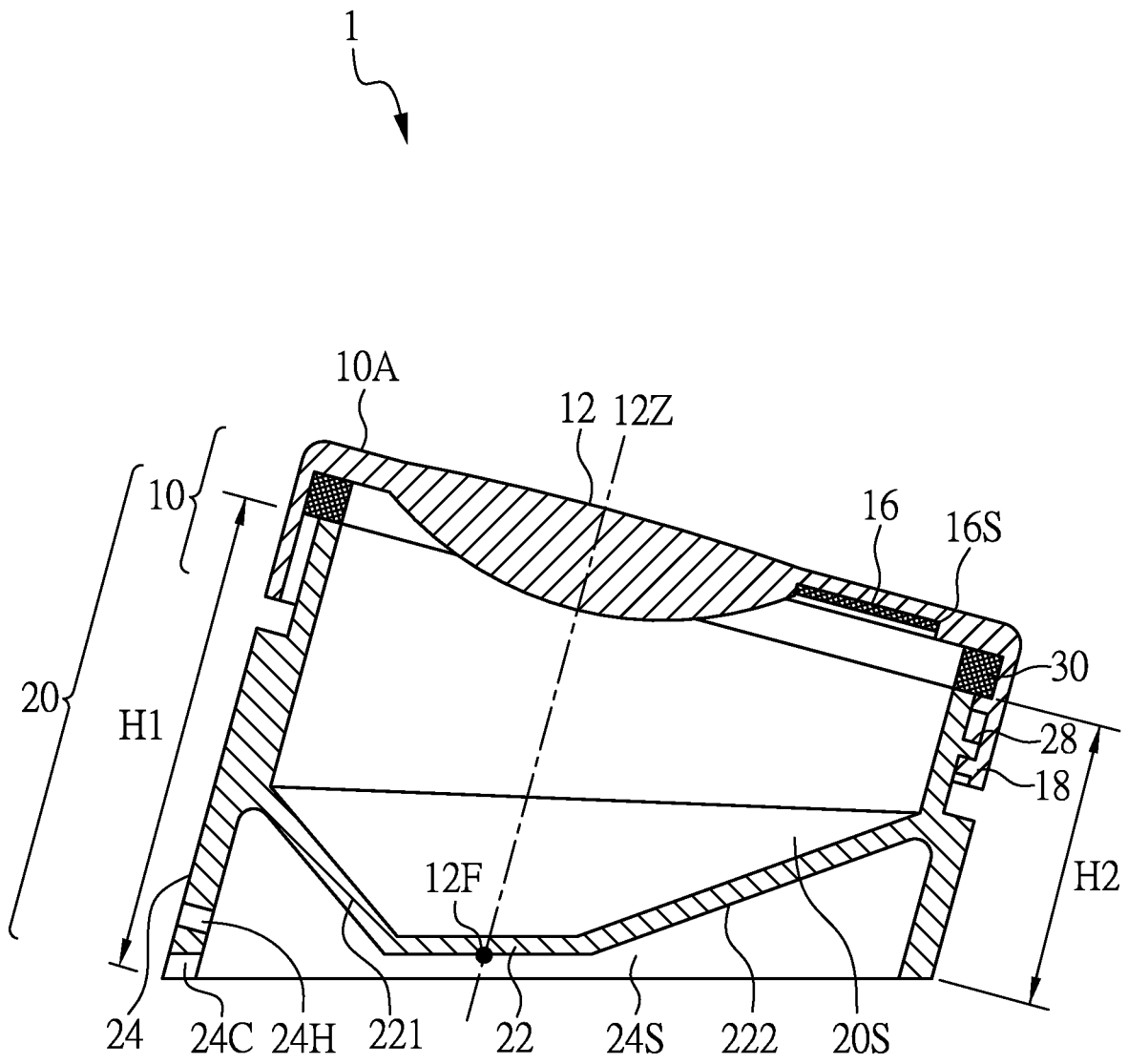
FIG. 2 is a cross-sectional view of the container according to one embodiment of the present invention.

Different embodiments of the present invention are provided in the following description. These embodiments are meant to explain the technical content of the present invention, but not meant to limit the scope of the present invention. A feature described in an embodiment may be applied to other embodiments by suitable modification, substitution, combination, or separation.

It should be noted that, in the present specification, when a component is described to have an element, it means that the component may have one or more of the elements, and it does not mean that the component has only one of the element, except otherwise specified.

Moreover, in the present specification, the ordinal numbers, such as "first" or "second", are used to distinguish a plurality of elements having the same name, and it does not means that there is essentially a level, a rank, an executing order, or an manufacturing order among the elements, except otherwise specified. A "first" element and a "second" element may exist together in the same component, or alternatively, they may exist in different components, respectively. The existence of an element described by a greater ordinal number does not essentially means the existent of another element described by a smaller ordinal number.

Moreover, in the present specification, the terms, such as "top", "bottom", "left", "right", "front", "back", or "middle", as well as the terms, such as "on" "above", "under", "below", or "between", are used to describe the relative positions among a plurality of elements, and the described relative positions may be interpreted to include their translation, rotation, or reflection.

Moreover, in the present specification, when an element is described to be arranged "on" another element, it does not essentially means that the elements contact the other element, except otherwise specified. Such interpretation is applied to other cases similar to the case of "on".

Moreover, in the present specification, the terms, such as "preferably" or "advantageously", are used to describe an optional or additional element or feature, and in other words, the element or the feature is not an essential element, and may be ignored in some embodiments.

Moreover, in the present specification, when an element is described to be "suitable for" or "adapted to" another element, the other element is an example or a reference helpful in imagination of properties or applications of the element, and the other element is not to be considered to form a part of a claimed subject matter; similarly, except otherwise specified; similarly, in the present specification, when an element is described to be "suitable for" or "adapted to" a configuration or an action, the description is made to focus on properties or applications of the element, and it does not essentially mean that the configuration has been set or the action has been performed, except otherwise specified.

With reference to FIGS. 1 to 5, the container 1 with lens for observing contents therein of the present invention includes a top lid 10 and a bottom box 20. Optionally, the top lid 10 and/or the bottom box 20 has a columnar shape, and the diameter of the top lid 10 is equal to a diameter of the bottom box 20, but is not limited thereto. The top lid 10 and the bottom box 20 can have any suitable shape, for example, an oval shape, a triangular shape, a square shape, a rectangular shape, a hexagonal shape, and so on.

The top lid 10 and the bottom box 20 can be made of glass, plastic, and so on.

The bottom box 20 includes a containing space 20S adapted to contain the contents. The contents may be fragrant materials, such as living plants or animals, or their specimens, or non-living solids or liquids.

The top lid 10 is removably assembled with the bottom box 20. The top lid 10 includes a lens 12 for observing the aforementioned contents. The lens 12 may be a magnifier to magnify the image of the contents so that the user can observe the details of the contents. Preferably, the lens 12 is integrally formed in the top lid 10. The integral formation of the present invention means that the lens 12 and the top lid 10 are made of the same material and by the same manufacturing process, preferably at the same time. In comparison with a conventional assembly or adhesion, the integral formation of the present invention can avoid lens detachment.

The top lid 10 is formed with a plurality of air holes 14 on a top surface 10A, and the fragrance of the contents can flow out from the air holes 14. Moreover, the top lid 10 may include a sliding rail 16S below the top surface 10A and a sliding plate 16 sliding along the sliding rail 16S. Considering the best space utilization, the sliding rail 16S and the sliding plate 16 are preferably adjacent to the lens 12. In particular, the sliding rail 16S and the sliding plate 16 may be arc-shaped so that they can fit a part of a circumference of the lens 12. Anyway, the sliding rail 16S and the sliding plate 16 may have any suitable shape as long as they can realize their function.

Then, the sliding plate 16 is formed with a plurality of air channels 16H corresponding to the air holes 14 on the top surface 10A of the top lid 10. Furthermore, the sliding plate 16 includes a protrusion 16P emerging above the top surface 10A of the top lid 10, and the sliding plate 16 slides forward or backward along the sliding rail 16S when a force is applied to the protrusion 16P.

Figure 4:
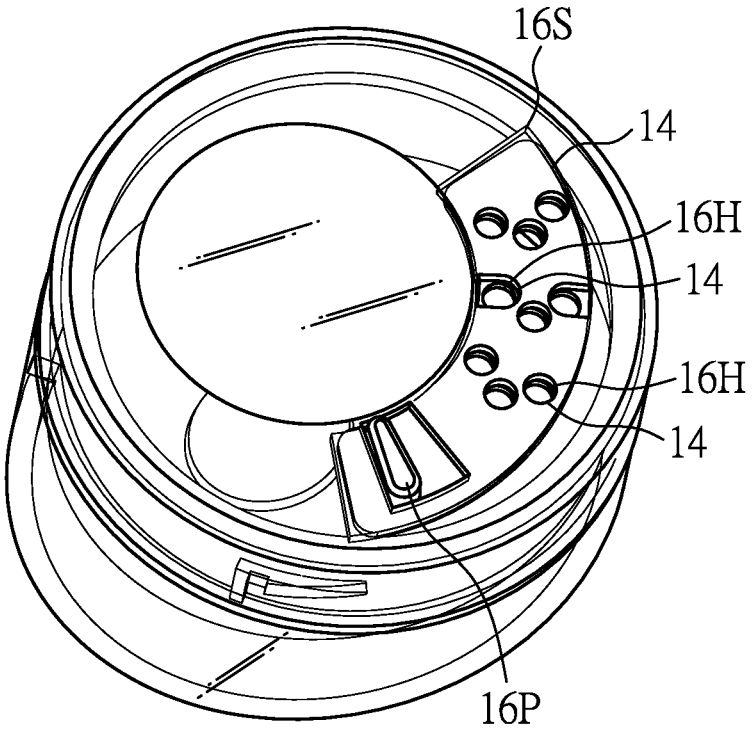
FIGS. 4 and 5 are schematic diagrams to illustrate how to open and close the air holes by sliding the sliding plate of the container of the present invention.
Figure 5:
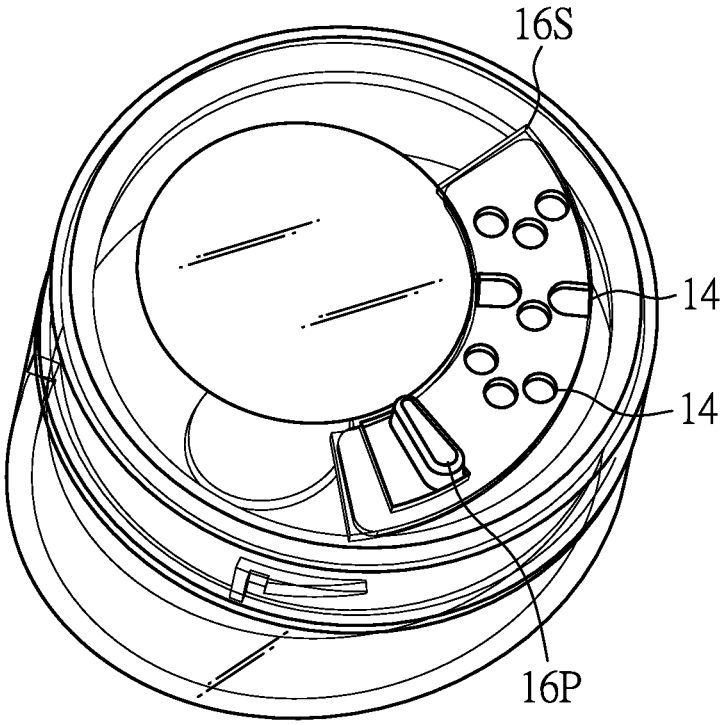

To discuss the operation of the sliding plate 16, in the referential system of FIGS. 4 and 5, when the user slides the protrusion 16P to the left side, the air channels 16H of the sliding plate 16 can match the air holes 14 on the top surface 10A of the top lid 10, and accordingly the fragrance of the contents can flow out. Alternatively, when the user slides the protrusion 16P to the right side, the closed portion of the sliding plate 16 blocks the air holes 14 on the top surface 10A of the top lid 10, and accordingly the fragrance of the contents cannot flow out.

The bottom box 20 has a tilted shape. In particular, the bottom box 20 has one side height H1 greater than another side height H2, as shown in FIGS. 3 and 4. With such tilted shape, the top surface 10A of the top lid 10 can face the user, and the user can conveniently observe the top surface 10A of the top lid 10 without craning his/her neck. It is possible for the user to observe the contents from the top surface 10A even at a far distance.

The bottom box 20 includes an outer shell 24. The outer shell 24 has an upper section forming the containing space 20S and a lower section forming an external space 24S. The containing space 20S is isolated from the external space 24S.

According to the present invention, the bottom box 20 includes a recess 22 serving as a part of the containing space 20S, and the recess 22 can gather the contents. Preferably, the recess 22 is located on a symmetric axis 12Z of the lens 12, particularly in front of at a focal point 12F of the lens 12, in order to obtain the best magnification of the image of the contents. To provide a magnified image, the lens 12 may be a convex lens.

Moreover, the bottom box 20 further includes one or more sloped walls 221, 222 connected with the recess 22. The contents may fall along the sloped walls 221, 222 until they arrive at the recess 22. The sloped walls 221, 222 may be integrated into a continuous wall surrounding the recess 22. In some cases, the slope of one sloped wall 221 is different to a slope of another sloped wall 222, depending on the location of the recess 20 further depending on the location of the lens 12.

Figure 6:
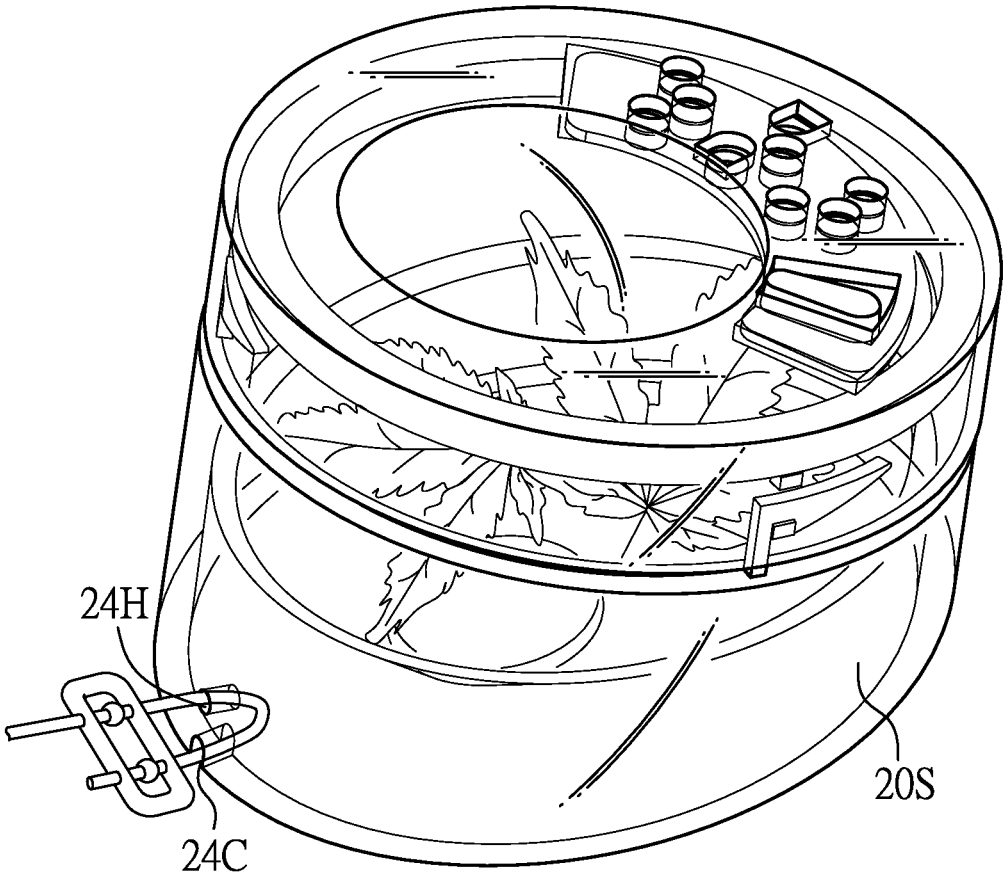
FIG. 6 shows a schematic diagram of one application of the container of the present invention, wherein a plant is stored in the container.

Optionally, the outer shell 24 is formed with an anti-theft hole 24H and an anti-theft channel 24C which are adapted for an anti-theft chain to pass through, as illustrated in FIG. 6, so the entire container 1 can be locked on a heavy object, such as a wall, a table, a desk, and so on.

Optionally, the whole top lid 10 and/or the whole bottom box 20 is transparent (or semi-transparent) so that the user can see the contents inside the container 1 directly. However, it is also possible that the lens 12 remains transparent (or semi-transparent) while the whole or a part of the top lid 10 and/or the whole or a part of the bottom box 20 is opaque.

Figure 3A:
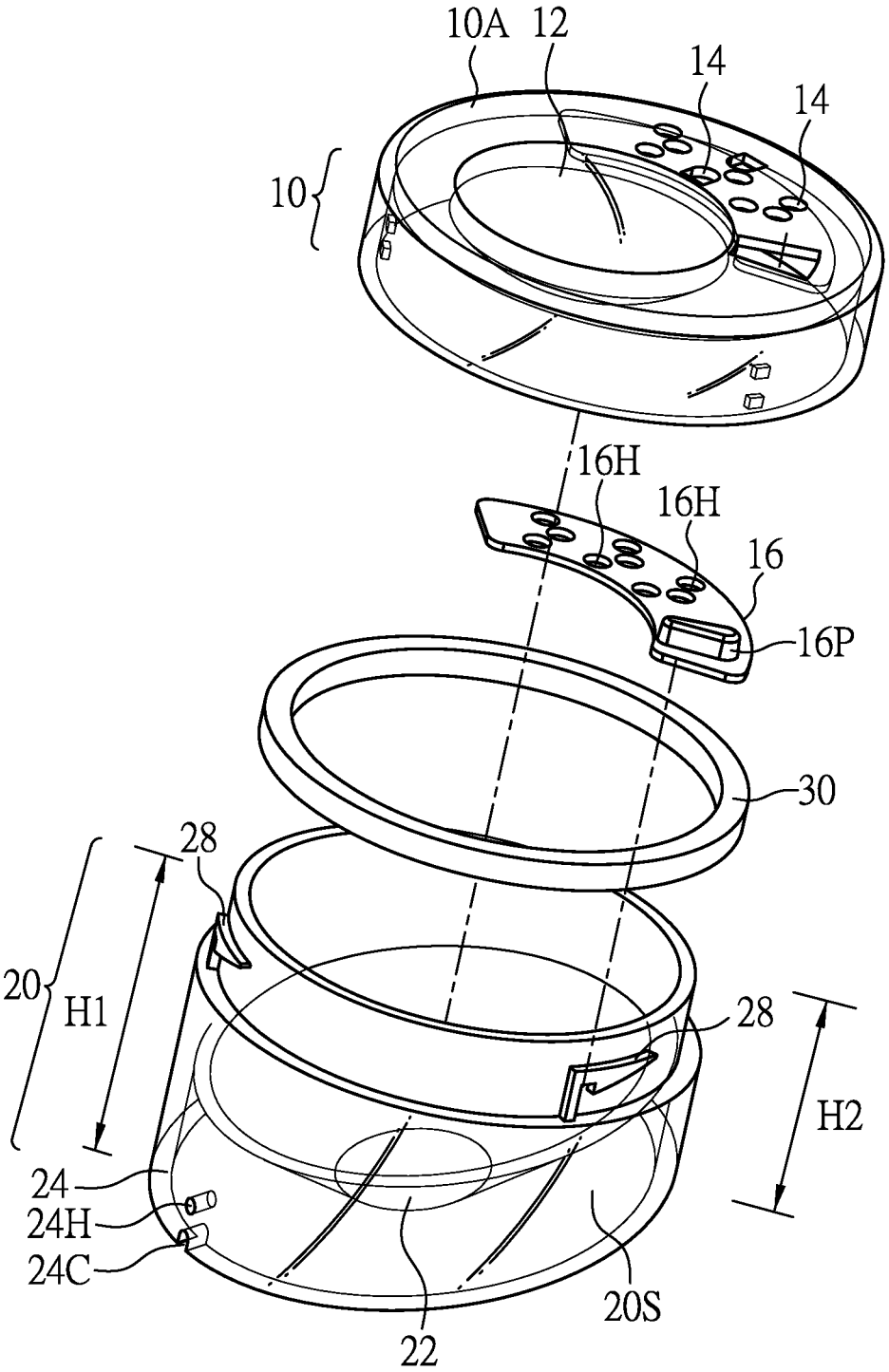
FIG. 3A is an exploded view of the container according to one embodiment of the present invention.
Figure 3B:
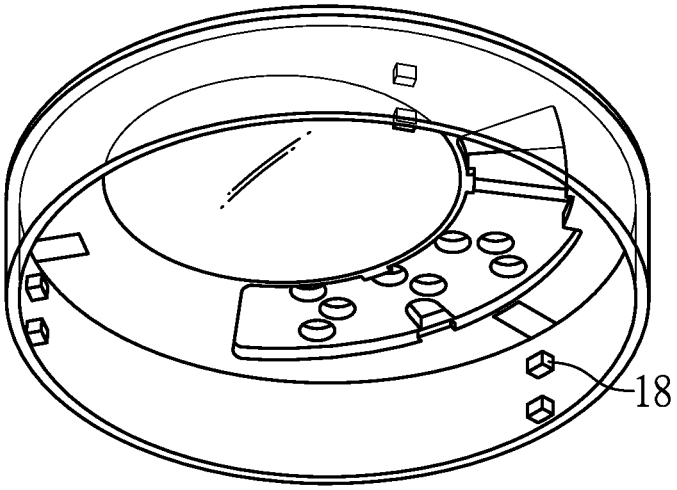
FIG. 3B is an upside-down view of the top lid showing the female coupler of the top lid.
Figure 3C:
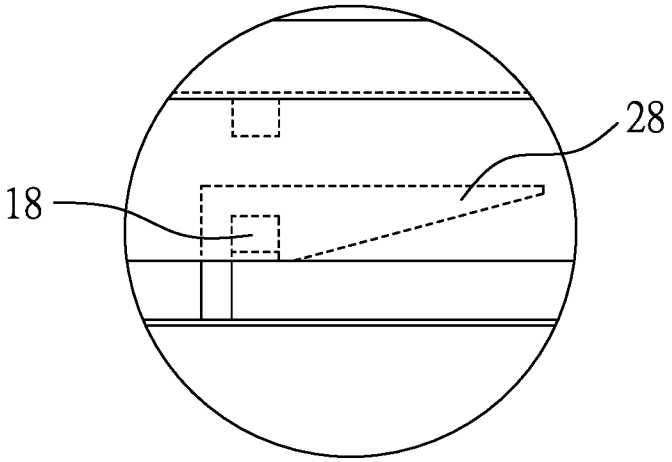
FIG. 3C is a cross-sectional view showing the coupling between the female coupler of the top lid and the male couplers of the bottom box.

To realize the assembly between the top lid 10 and the bottom box 20, the top lid 10 may include one or more female couplers 18, and the bottom box may include one or more male couplers 28 capable of coupling to the female couplers 18, as shown in FIG. 3C. Each male coupler 28 is shaped so as to be coupled with each female coupler 18 by a rotational force and a subsequent pulling force. Or, each male coupler 28 is shaped so as to be decoupled from each female coupler 18 by a pushing force and a subsequent rotational force. Please note that FIG. 3B is an upside-down view of the top lid in comparison with FIG. 3A.

To enhance the airtightness of the assembly, an O-ring 30 may be arranged between the top lid 10 and the bottom box 20.

Although the present invention has been explained in relation to its preferred embodiment, it is to be understood that many other possible modifications and variations can be made without departing from the spirit and scope of the invention as hereinafter claimed.

What is claimed is:

1. A container with lens for observing contents therein, comprising: a bottom box including a containing space adapted to contain the contents, the bottom box having a tilted shape wherein the bottom box has one side height greater than another side height, wherein the bottom box includes a recess serving as a part of the containing space; and a top lid with an integrally formed lens and formed with a plurality of air holes on a top surface thereof, wherein the lens and the top lid are made of same material and by same manufacturing process; the top lid being removably assembled with the bottom box; and wherein the recess is located in front of a focal point of the lens.

2. The container as claimed in claim 1, wherein the whole or a part of the top lid and/or the whole or a part of the bottom box is transparent, semi-transparent, or opaque.

3. The container as claimed in claim 1, wherein the top lid further includes a sliding rail below the top surface and a sliding plate sliding along the sliding rail, and the sliding plate is formed with a plurality of air channels corresponding to the air holes on the top surface.

4. The container as claimed in claim 3, wherein the sliding plate includes a protrusion emerging above the top surface of the top lid, and the sliding plate slides forward or backward along the sliding rail when a force is applied to the protrusion.

5. The container as claimed in claim 3, wherein the sliding rail and the sliding plate are adjacent to the lens.

6. The container as claimed in claim 3, wherein the sliding rail and the sliding plate are arc-shaped fitting a part of a circumference of the lens.

7. The container as claimed in claim 1, wherein the bottom box includes an outer shell, the outer shell has an upper section forming the containing space and a lower section forming an external space, and the containing space is isolated from the external space.

8. The container as claimed in claim 7, wherein the outer shell is formed with an anti-theft hole and an anti-theft channel which are adapted for an anti-theft chain to pass through.

9. The container as claimed in claim 1, wherein the recess is located on a symmetric axis of the lens.

10. The container as claimed in claim 1, wherein the bottom box further includes one or more sloped walls connected with the recess.

11. The container as claimed in claim 10, wherein a slope of one sloped wall is different to a slope of another sloped wall.

12. The container as claimed in claim 10, wherein the sloped walls are integrated into a continuous wall surrounding the recess.

13. The container as claimed in claim 1, wherein the top lid further includes one or more female couplers, and the bottom box further includes one or more male couplers capable of coupling to the female couplers.

14. The container as claimed in claim 13, wherein each male coupler is shaped so as to be coupled with each female coupler by a rotational force and a subsequent pulling force; or each male coupler is shaped so as to be decoupled from each female coupler by a pushing force and a subsequent rotational force.

15. The container as claimed in claim 1, wherein the top lid and/or the bottom box has a columnar shape.

16. The container as claimed in claim 15, wherein a diameter of the top lid is equal to a diameter of the bottom box.

17. The container as claimed in claim 1, further comprising an O-ring arranged between the top lid and the bottom box.

* * * * *